US009415252B2

(12) United States Patent
Delle Donne

(10) Patent No.: US 9,415,252 B2
(45) Date of Patent: Aug. 16, 2016

(54) ROTOR WITH VARIABLE HYDRODYNAMIC RESISTANCE FOR A STATIONARY WATER BICYCLE AND RELATED BICYCLE

(75) Inventor: Daniele Delle Donne, San Mauro Pascoli (IT)

(73) Assignee: ESSENUOTO ITALIA DI DELLE DONNE DANIELE & C. S.A.S., San Mauro Pascoli FC (IT)

( * ) Notice: Subject to any disclaimer, the term of this patent is extended or adjusted under 35 U.S.C. 154(b) by 1274 days.

(21) Appl. No.: 13/138,572

(22) PCT Filed: Mar. 4, 2010

(86) PCT No.: PCT/IB2010/000473

§ 371 (c)(1),
(2), (4) Date: Nov. 18, 2011

(87) PCT Pub. No.: WO2010/100562

PCT Pub. Date: Sep. 10, 2010

(65) Prior Publication Data

US 2012/0071302 A1 Mar. 22, 2012

(30) Foreign Application Priority Data

Mar. 6, 2009 (IT) ..... MI2009A0338

(51) Int. Cl.

| | |
|---|---|
| ***A63B 22/06*** | (2006.01) |
| ***B63H 3/10*** | (2006.01) |
| ***B64C 11/30*** | (2006.01) |
| ***F01D 7/00*** | (2006.01) |

(Continued)

(52) U.S. Cl.

CPC ..... *A63B 21/0084* (2013.01); *A63B 21/00069* (2013.01); *A63B 21/00076* (2013.01); *A63B 22/0605* (2013.01); *A63B 2208/03* (2013.01)

(58) Field of Classification Search

CPC .. A63B 22/08; A63B 21/00036; A63B 21/06; A63B 21/08; A63B 21/0081; A63B 21/0084; A63B 21/00076; A63B 21/00069; A63B 31/18; A63B 69/16; A63B 21/008; A63B 35/00; A63B 35/008; A63B 35/12; F04D 15/0055; F01D 7/02

USPC ..... 482/57, 58, 63, 64, 72, 73, 111, 112; 180/165; 416/9, 54, 134 R, 135–138, 416/159, 162, 168 R, 27, 44, 46, 107, 140; 440/13, 21, 26

See application file for complete search history.

(56) References Cited

U.S. PATENT DOCUMENTS

| | | | | |
|---|---|---|---|---|
| 244,677 | A * | 7/1881 | Sherwood | 416/117 |
| 3,932,054 | A * | 1/1976 | McKelvey | 415/130 |

(Continued)

OTHER PUBLICATIONS

International Search Report dated May 6, 2010.

*Primary Examiner* — Oren Ginsberg
*Assistant Examiner* — Nyca T Nguyen
(74) *Attorney, Agent, or Firm* — Hedman & Costigan, P.C.; James V. Costigan; Kathleen A. Costigan

(57) ABSTRACT

A rotor with variable hydrodynamic resistance for a stationary water bicycle comprises a central body provided on its perimeter with a plurality of blades of the marine type comprising an inlet edge, an outlet edge and a convex helical surface, as well as provided on opposite outer faces with axles per pedals, wherein each blade, at the outlet edge, is connected to the rotor with elastic fixing means adapted to allow the automatic orientation of the blade as a function of the rotation speed imparted to the rotor through the pedals, the central body houses means for adjusting the maximum possible opening comprising a mechanical end stop element movable for modifying the maximum possible opening of each blade, such means for adjusting the maximum possible opening of the blades being able to be actuated by control means connected at one end to the means for adjusting the maximum possible opening.

16 Claims, 13 Drawing Sheets

(51) Int. Cl.
*A63B 21/008* (2006.01)
*A63B 21/00* (2006.01)

(56) References Cited

U.S. PATENT DOCUMENTS 3,994,180 A * 11/1976 Ackerman ..... 474/56
5,123,641 A 6/1992 Abboudi
5,326,223 A * 7/1994 Speer ..... 416/46
5,368,442 A * 11/1994 Speer ..... 416/167
5,665,039 A * 9/1997 Wasserman et al. ..... 482/111
5,690,588 A 11/1997 Lavore
5,795,270 A 8/1998 Woods et al.
6,767,186 B2 * 7/2004 Olesiewicz ..... 416/136
7,955,227 B2 * 6/2011 Chen ..... 482/58
8,444,385 B2 * 5/2013 Yonge ..... 416/43

* cited by examiner

13"
13'
13
21
23
20
22
24
25
26
27
28

ROTOR WITH VARIABLE HYDRODYNAMIC RESISTANCE FOR A STATIONARY WATER BICYCLE AND RELATED BICYCLE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY- REFERENCE OF MATERIAL SUBMITTED ON A COMPACT DISC OR AS A TEXT FILE VIA THE OFFICE ELECTRONIC FILING SYSTEM (EFS-WEB)

Not Applicable

STRATEMENT REGARDING PRIOR DISCLOSURES BY THE INVENTOR OR A JOINT INVENTOR

Not Applicable

BACKGROUND OF THE INVENTION

1) Field of the Invention

The present invention refers to a rotor with variable hydrodynamic resistance for a stationary water bicycle and to a related bicycle.

2) Description of Related Art

Stationary water bicycles, called stationary "hydrobikes", are known to be used for carrying out fitness activities, rehabilitation, developing and toning of muscles in the legs and in the waist, athletic training and weight loss activities.

Stationary water bicycles comprise a frame and a pair of pedals to which means are generally connected for increasing the peddling resistance and thus the intensity of the physical activity.

A different type of hydrobike comprises a bladed rotor, fixedly connected centrally to the frame and connected to the pedals. The intensity can be set by manually adjusting the opening of the blades and the related resistance according to a plurality of preset positions.

U.S. Pat. No. 5,690,588 shows, for example, a device of this type in which the flat blades can be manually oriented according to a preset number of angular positions with respect to the axle of the rotor. A button loaded by a helical spring ensures that the preset angular position is held until it is pressed to carry out a new adjustment.

BRIEF SUMMARY OF THE INVENTION

The purpose of the present invention is that of making a rotor with variable hydrodynamic resistance for a stationary water bicycle and a relative bicycle that solve the drawbacks described.

Another purpose of the present invention is that of making a rotor with variable hydrodynamic resistance for a stationary water bicycle and a related bicycle in which the hydrodynamic resistance can vary while carrying out the exercise according to controlled parameters.

Another purpose of the present invention is that of making a rotor with variable hydrodynamic resistance for a stationary water bicycle and a related bicycle which is particularly simple and functional, with low costs.

These purposes according to the present invention are achieved by making a rotor with variable hydrodynamic resistance for a stationary water bicycle comprising a central body (12) provided on its perimeter with a plurality of blades (13), characterized in that said blades (13) are of the a marine type, comprising an inlet edge)(13'), an outlet edge (13")and a convex helical surface, said rotor being provided on opposite outer faces with axles (14) for pedals (15) , wherein each blade (13), at said outlet edge (13"), is connected to said rotor (10) with elastic fixing means (20) adapted to allow the automatic orientation of the blade (13) as a function of the rotation speed imparted to the rotor (10) through the pedals (15), wherein said central body (12) houses means for adjusting the maximum possible opening (30) of the blades comprising a mechanical end stop element (31) movable for Modifying the maximum possible opening of each blade (13), said means for adjusting the maximum possible opening (30) being able to be actuated by control means (40) connected at one end to said means for adjusting the maximum possible opening (30).

BRIEF DESCRIPTION OF THE SEVERAL VIEWS OF THE DRAWINGS

The characteristics and the advantages of a rotor with variable hydrodynamic resistance for a stationary water bicycle and of a related bicycle according to the present invention shall become clearer from the following description, given as an example and not for limiting purposes, with reference to the attached schematic drawings, in which.

DETAILED DESCRIPTION OF THE INVENTION

Figure 2:
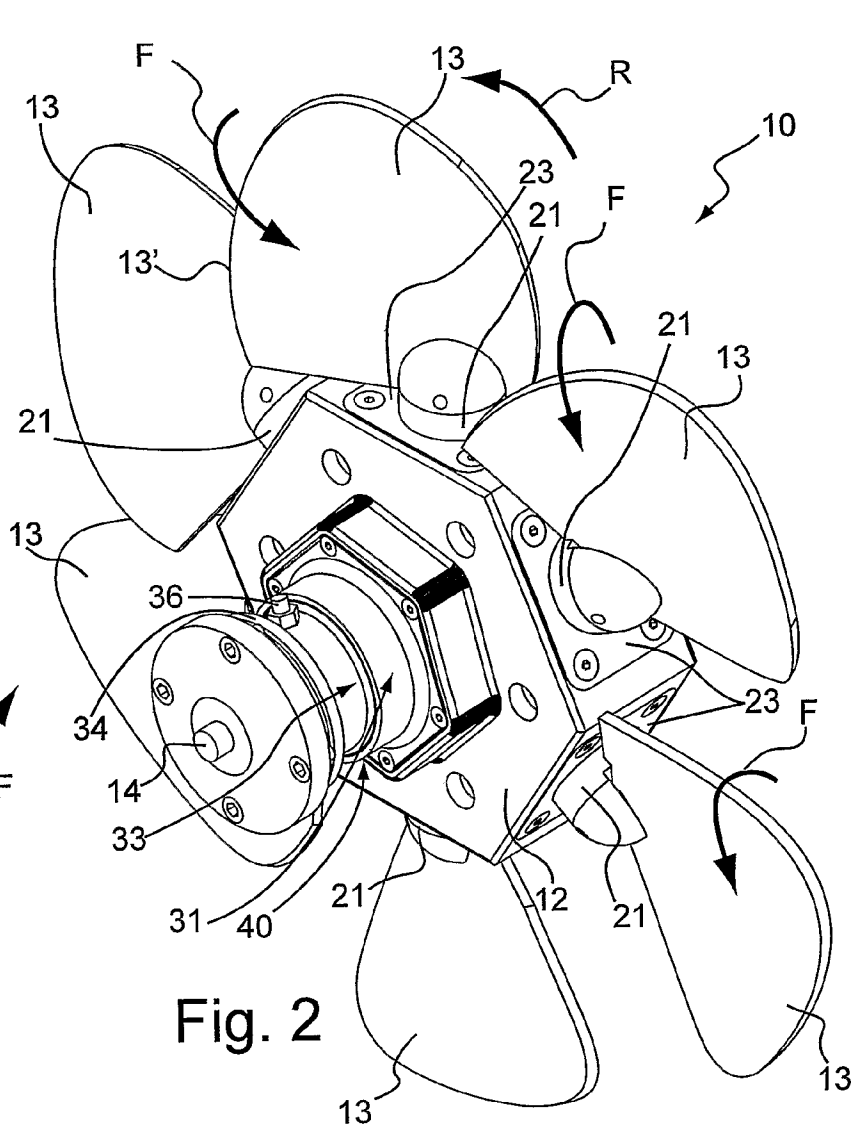
FIGS. 1 and 2 are perspective views of opposite sides of a rotor for a stationary water bicycle.

With reference to the figures, a rotor is shown with variable hydrodynamic resistance for a stationary water bicycle, wholly indicated with reference numeral 10 and a related stationary water bicycle, indicated with reference numeral 100.

According to the invention, the hydrodynamic resistance can vary progressively based upon the rotation speed imparted to the rotor due to the peddling, between a fixed minimum resistance value and a maximum resistance value that can be predetermined before starting or while doing exercise and not necessarily reached during it.

Figure 1:
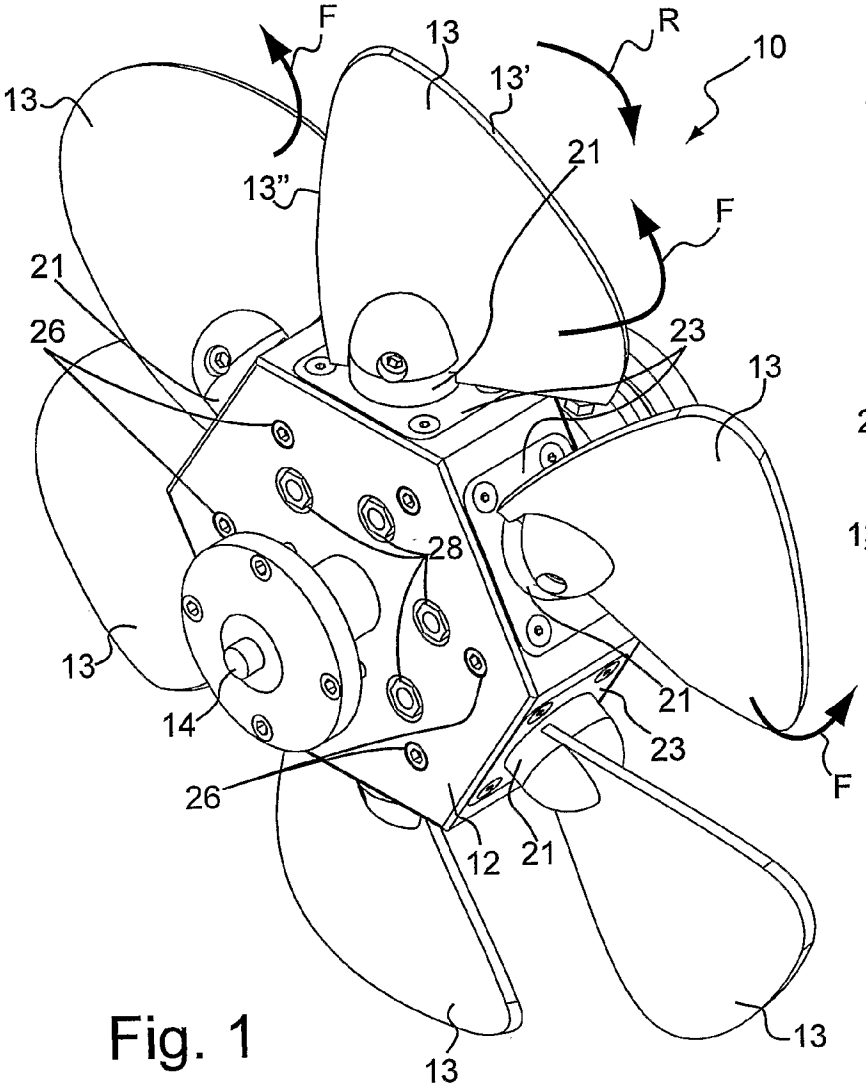

The rotor 10, that constitutes a rotating mass, comprises a central body 12 on the perimeter of which a plurality of blades 13 are applied equally spaced apart from one another. The central body 12, from which axles 14 of the pedals 15 extend outside on opposite faces, houses means for adjusting the maximum possible opening of the blades 13 (FIGS. 1 and 2).

In the non limiting example shown, the rotor 10 can be hexagonal, round or circular, as shown, as well as having any other shape, and it is provided with six blades 13. According to the invention, the number of blades can also be different and, in any case, at least two.

Each blade 13 is of the marine type, in other words it has a helical shape with an inlet edge 13' and an outlet edge 13" and a convex surface.

Each blade 13 is connected to the rotor through elastic fixing means 20, which allow it to be automatically oriented, as a function of the rotation speed and thrust imparted to the rotor 10 by the legs of the person peddling, so as to increase or decrease the screwing pitch in the fluid in which it is dipped, and thus the resistance to force.

This makes it possible to vary, during the programmed operation, continuously and automatically, the smaller or greater opening of the blades 13 and thus the hydrodynamic resistance, based upon the greater or lower speed set for peddling.

The stiffness factor of the elastic fixing means 20 determines the ratio between the peddling speed and the opening of the blade.

Figure 3:
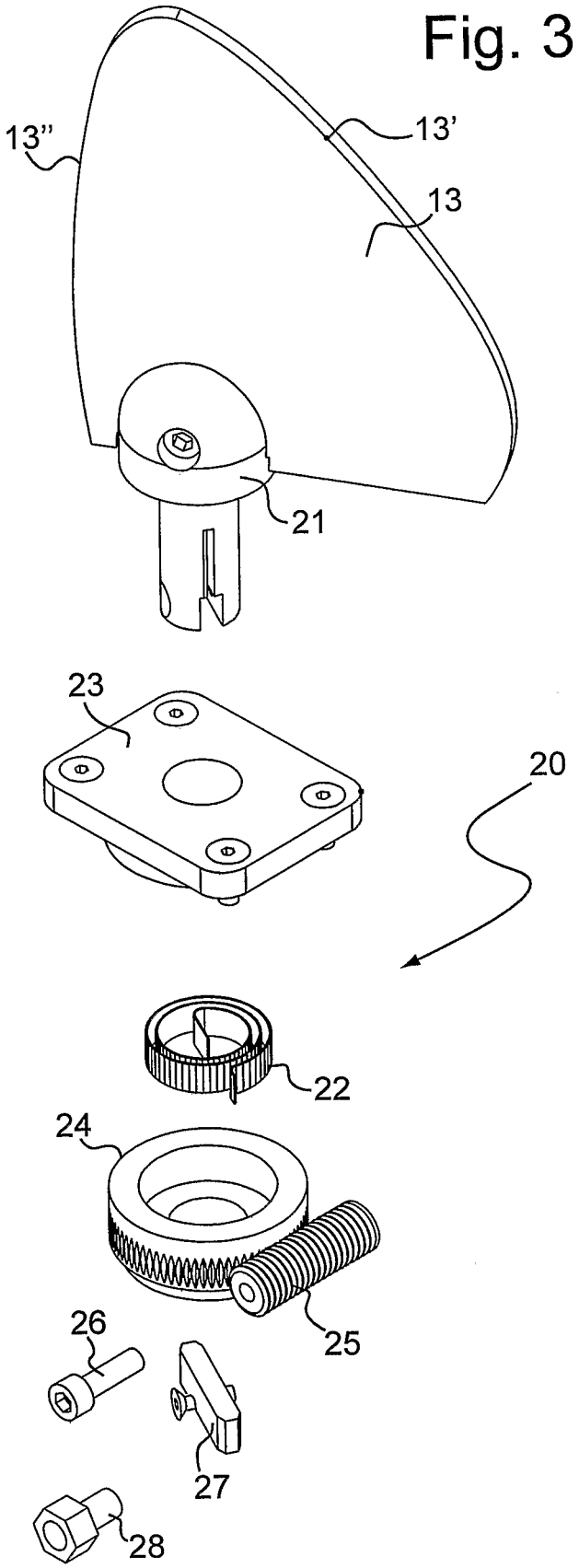
FIG. 3 is an exploded perspective view of a blade and of the elastic fixing means according to a first embodiment.

On the extension of the outlet edge 13" of the propeller there is a rotation pin 21 constrained to the blade 13 and coupled with the central body 12 of the rotor 10 through elastic means 22 which in part oppose its rotation (FIG. 3).

According to what has been shown in FIG. 1, in which the rotor 10 must rotate in a clockwise direction as schematized with the arrow R to introduce the inlet edge 13' of the blades 13 first into the water. As the rotation speed increases, the blades 13 progressively widen as indicated by the arrows F.

FIG. 2 shows the same rotor 10 of FIG. 1 from the opposite side.

The rotation pin 21 of the blades 13 placed on the extension of the outlet edge 13" of the blades ensures, thanks to their helical shape, the conveying of the fluid, and in this specific case water, which creates a current that starts at the centre of the propeller and radiates towards the outer perimeter determining a water current that licks legs and waist. Advantageously, while peddling, a toning massage of the muscles is obtained without jeopardizing the stability of the bicycle.

Indeed, if the rotation pin 21 of the blades 13 were placed on the extension of the inlet edge 13' of the water, the hydrodynamic resistance of the rotor 10 would be nullified and consequently there wouldn't be any water movement.

The elastic means, in the examples, consist of a strip spring 22, the tension of which can be adjusted manually so as to increase or decrease the force opposing the rotation of the blades 13 and thus reaching of a resistance position which is more or less high. By "strip springs" we mean any type of spiral spring with any height, comprising both a metallic band and a wire, equivalent to one another and which can be interchanged with one another for the purposes of the invention.

According to a first preferred embodiment shown, the rotation pin 21 is inserted and is free to rotate in a removable support 23, which can be connected to the central body 12 of the rotor 10, and in an adjuster bushing 24 of the strip spring 22. The strip spring 22 comprises a first end engaged with the pin 21 and a second end engaged with the bushing 24, in which it is contained.

A worm screw 25 is engaged with the outer surface of the adjuster bushing 24 of the strip spring 22.

The adjustment of the load of the spring 22 can be carried out by adjusting the worm screw 25 from outside the rotor 10, with a special wrench that is not shown, said screw then being locked through a locking screw 26 singularly for each blade when the rotor is not moving.

According to further embodiments of the rotor according to the invention, shown in FIGS. 8-12, centralized adjustment means 50 of the load of the springs 22 are foreseen, which make it possible to vary the load of all the springs simultaneously and also while the rotor is moving.

The centralized adjustment means 50 of the load of the springs 22 comprise an outer dome 51 fixed to one of the two support plates 16, which support the rotor 10 on opposite sides, and equipped with helical grooves 52, in which drive screws 53 are engaged extending out from the outer surface of a thrust ring 54 that is set in rotation by control means 60 and guided in translation by the helical grooves 52.

The thrust ring 54 is coupled in abutment with an annular slider 55, on the circumference of which a plurality of connection elements with a bushing 24 are fixedly connected, in an equal number to the bushings 24 themselves.

Figure 8:
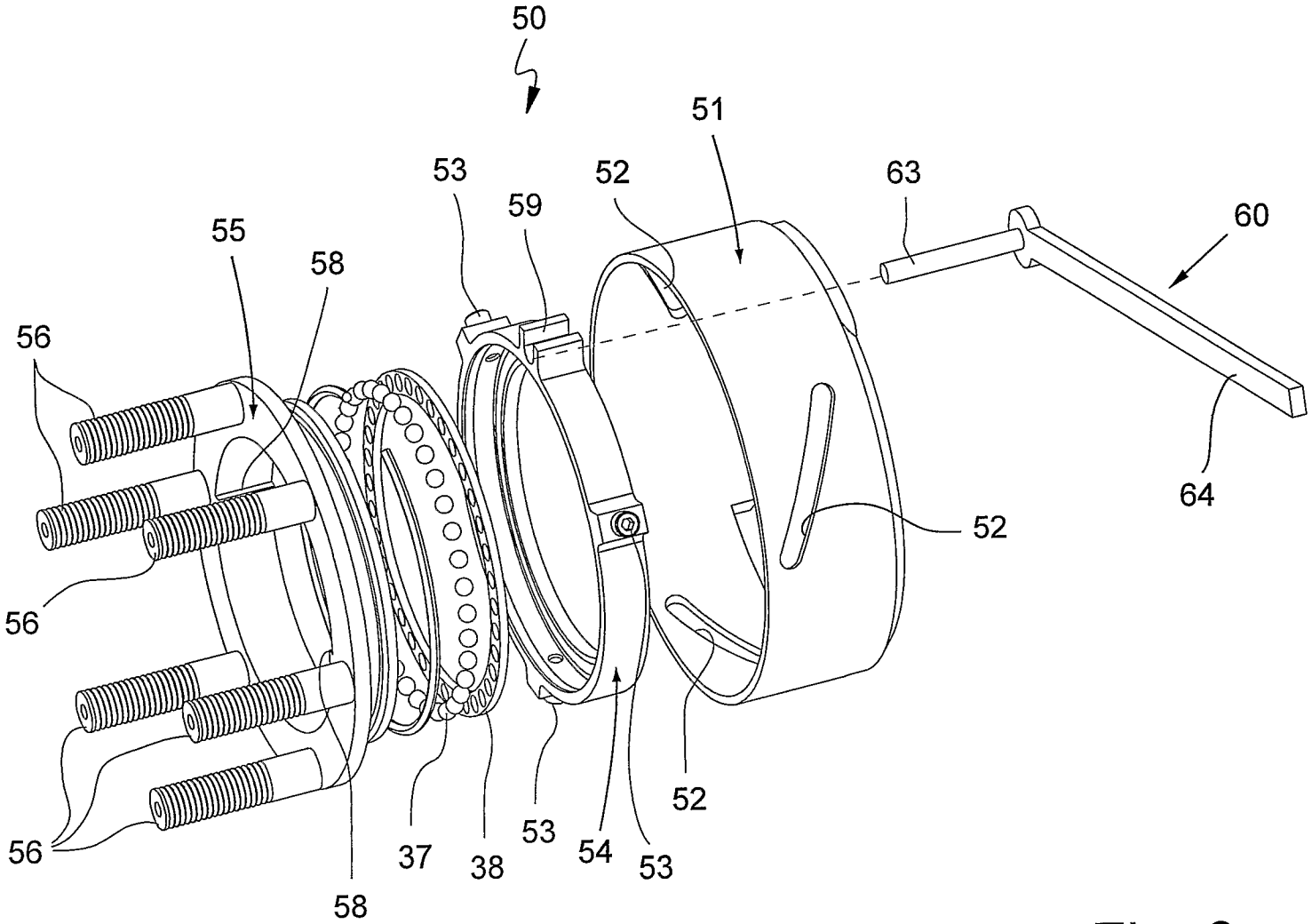
FIGS. 8 and 9 show enlarged details, in an exploded view, of two different embodiments of centralized adjustment means of the load of the springs for a rotor according to the invention.

In the first embodiment of FIG. 8, the connection elements are made up of a plurality of threaded adjuster pins 56 fixedly connected, for example with screws, to a flat annular surface of the annular slider 55, oriented towards the body of the rotor 12, and each engaged with the outer surface of the bushing 24 of the elastic fixing means 20 of the blades 13.

Figure 10:
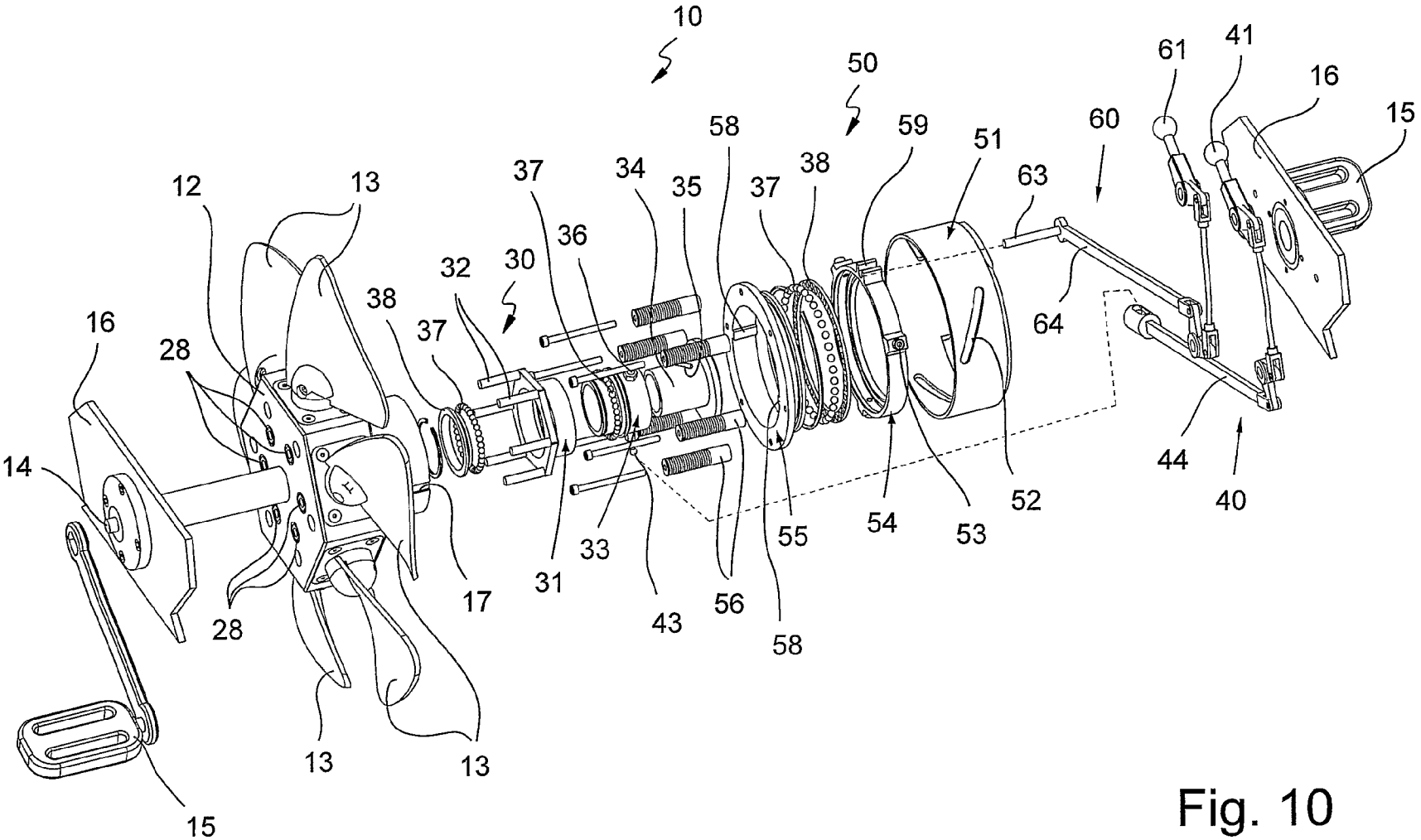
FIGS. 10 and 11 respectively show the rotor according to the invention equipped with the centralized adjustment means of the load of the springs of FIGS. 8 and 9.

The annular slider 55 comprises, on the inner surface of the hole, at least one key 58 for engaging in at least one matching seat 17 of the central body of the rotor 12 that guides the axial sliding of the annular slider 55 with respect to the central body 12 of the rotor 10, as shown in the exploded view of FIG. 10.

The connection between the thrust ring 54, which stays still during operation, unless it is set in rotation by the control means 60, and the annular slider 55, which rotates as a unit with the central body of the rotor 12, unless it is also moved in translation by the control means 60, is obtained with a ball crown 37 and with a relative ring 38 that identifies a seat for the balls 37 which is held in position by a clip ring.

Thanks to this, the system can operate even when the rotor 10 is moving, in other words, carrying out the adjustment while continuing to peddle.

The control means 60 of the centralized adjustment means 50 of the load of the springs 22 comprise, according to the preferred embodiment of the invention, a manoeuvring lever 61 applied to the frame 11 of the stationary water bicycle 100, in a position which is practical for the user. The manoeuvring lever 61 can be pivoted in a box, not shown, and can be rotated continuously or in a preset number of positions.

Therefore, by rotating the thrust ring 54 with respect to the outer dome 51, fixed to one of the support plates 16, an axial movement of said thrust ring 54, of the annular slider 55 and of all that is connected to it, is obtained.

All the threaded adjuster pins 56 are simultaneously brought into engagement with the relative adjuster bushings 24, varying the angular position to determine a variation of the load of the springs 22.

Figure 9:
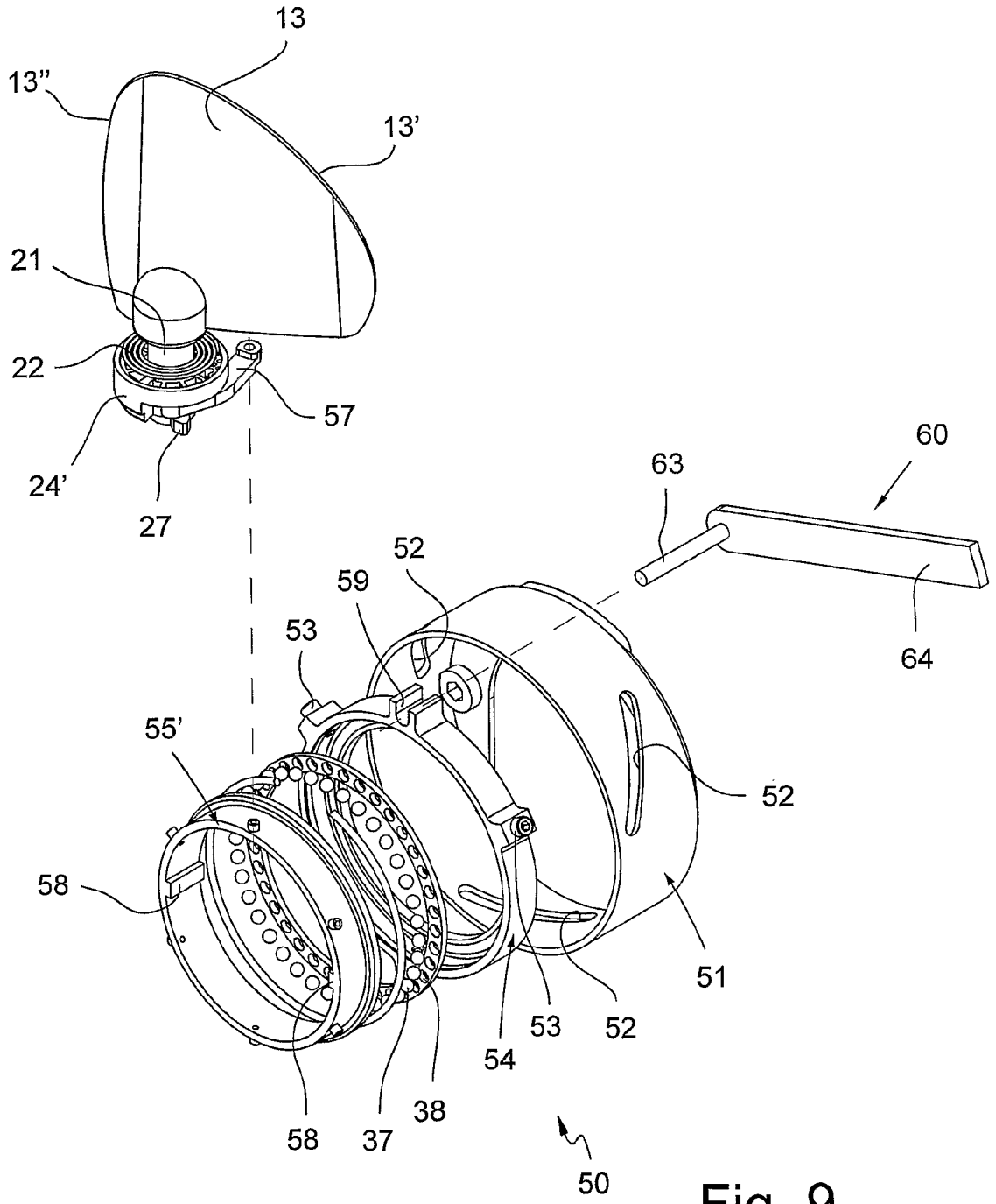

In the second embodiment of FIG. 9, the connection elements are, on the other hand, made up of a plurality of adjuster levers hinged on the outer shell of an annular slider 55', for each engaging with a bushing 24 of the elastic fixing means 20 of the blades 13.

The enlarged detail of FIG. 9 shows the adjuster lever 57 pivoted outside an adjuster bushing 24' that houses a strip spring 22 made up of a wire.

Figure 11:
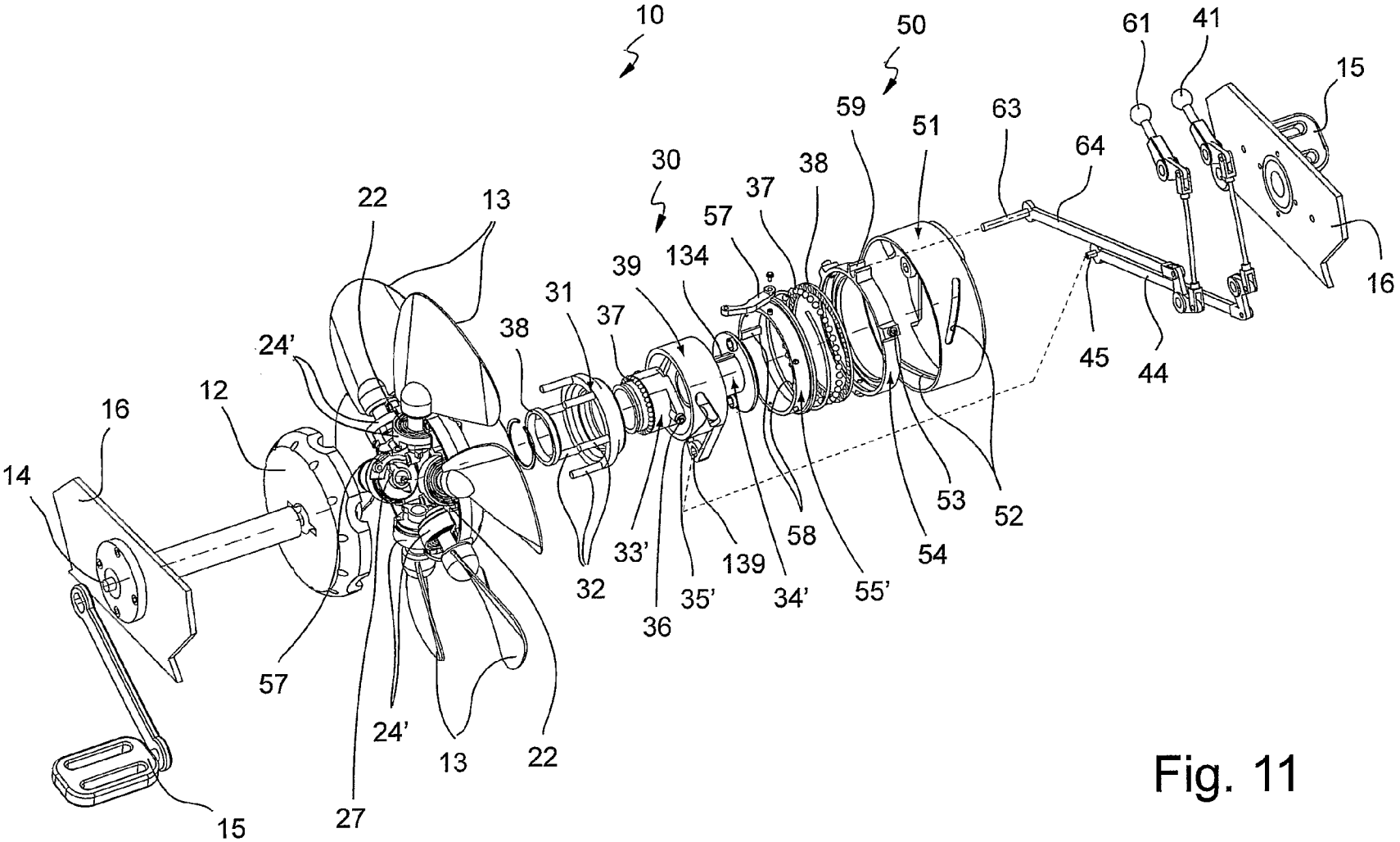

The axial translation of the annular slider 55' on the central body 12 of the rotor 10 shown in the exploded view of FIG. 11, is controlled in a completely analogous way as that described for the first embodiment through the keys 58.

Moreover, in all the described embodiments, at the end of the rotation pin 21 that extends with respect to the bushing 24 an abutment cross beam 27 is applied.

The purpose of the spring 22 is that of holding the cross beam 27—in its rest position—in contact with an initial position adjuster screw 28, which is screwed and locked onto the central body 12 of the rotor 10 in a direction perpendicular to the rotation axis of the pin 21, and can be accessed from outside of it (FIG. 1). The initial position of minimum opening of each blade 13 is thus determined.

The adjustment of the initial position adjuster screw 28 and of the load of the spring 22 are preset by the manufacturer, so therefore the user should not have to intervene, other than through personnel specialized in equipment maintenance.

Through the adjustment of the strip springs 22 it is possible to automatically program even a fast pace peddling with a minimum or preset opening of the blades so as to control the effort in overcoming the resistance of the water without necessarily making it conditional upon the complete opening of the blades.

Figure 4:
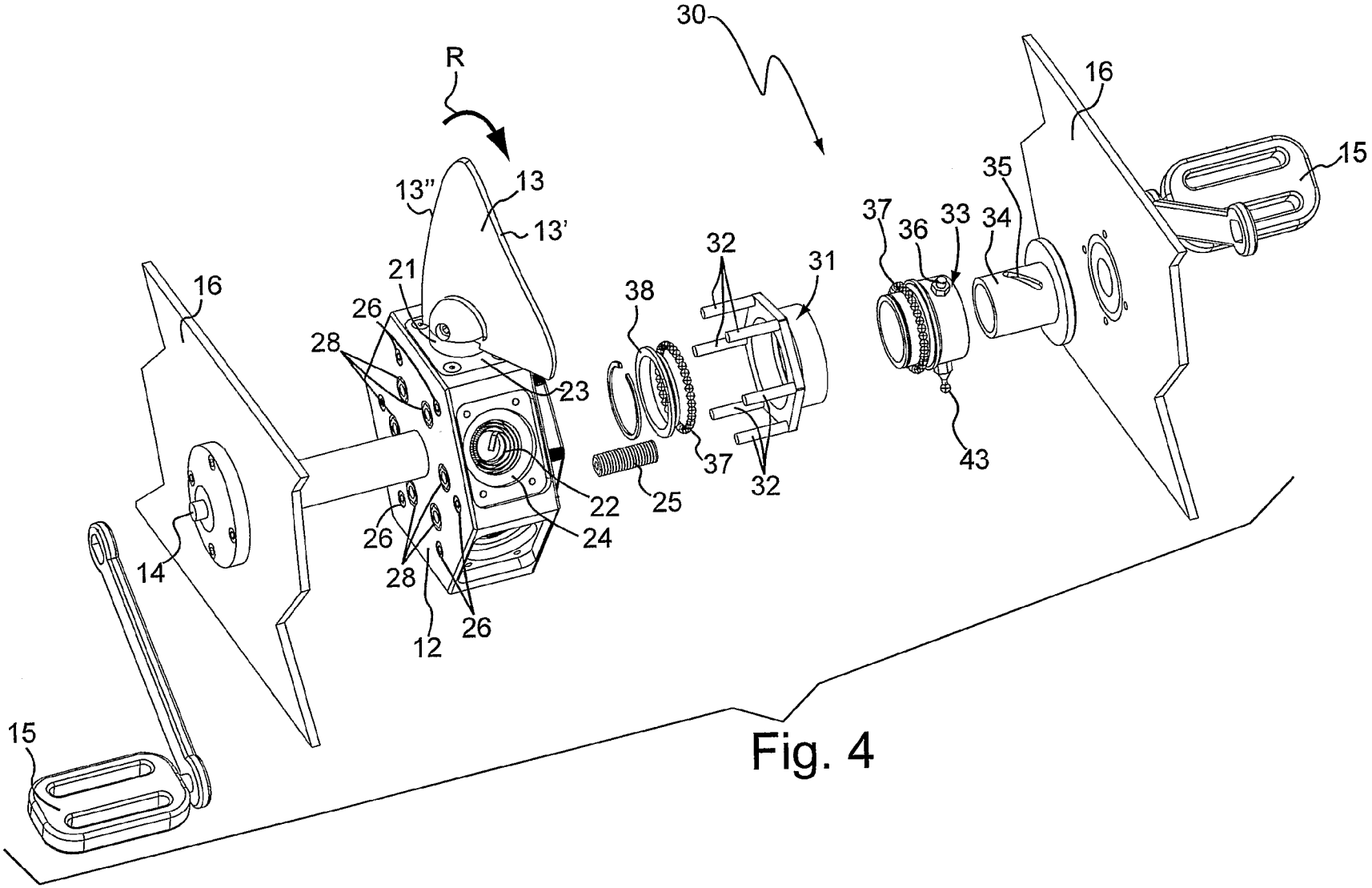
FIG. 4 is a partial exploded view of the rotor of FIG. 1, which shows the means for adjusting the maximum possible opening of the blades according to a first embodiment.

The field of rotation of the blades 13, which in the example shown is of about 60°, is determined by the means for adjusting the maximum possible opening 30, shown in FIG. 4, that set an end stop which can be modified by the user, even during operation.

During operation, the blades 13 are progressively arranged in positions, based upon the speed of the peddling, ranging between a fixed initial position of "minimum possible opening" and a position of "maximum possible opening" which can be controlled manually before or during operation.

It is thus possible that during operation, at the peak of resistance encountered, the blades 13 do not reach the end stop of maximum possible opening.

It is thus necessary to make a distinction between the "position of maximum possible opening", that represents the one which can be achieved in theory and defined by the adjustment means 30, and the "position of maximum resistance", which represents the actual position reached by the blade during operation due to the elastic fixing means 20.

According to the preferred embodiment shown, the field of rotation of the blades 13 is determined by the distance between the initial position adjuster screw 28 and a movable end stop flange 31, that constitutes a mechanical end stop element to limit the rotation of the cross beam 27 and therefore of the blade 13 itself.

The movable end stop flange 31 comprises a plurality of abutment pins 32, one for each blade 13, the ends of which are situated opposite with respect to the respective initial position adjuster screws 28. This configuration makes it possible to simultaneously adjust the same end stop for all the blades of the rotor.

Figure 6A:
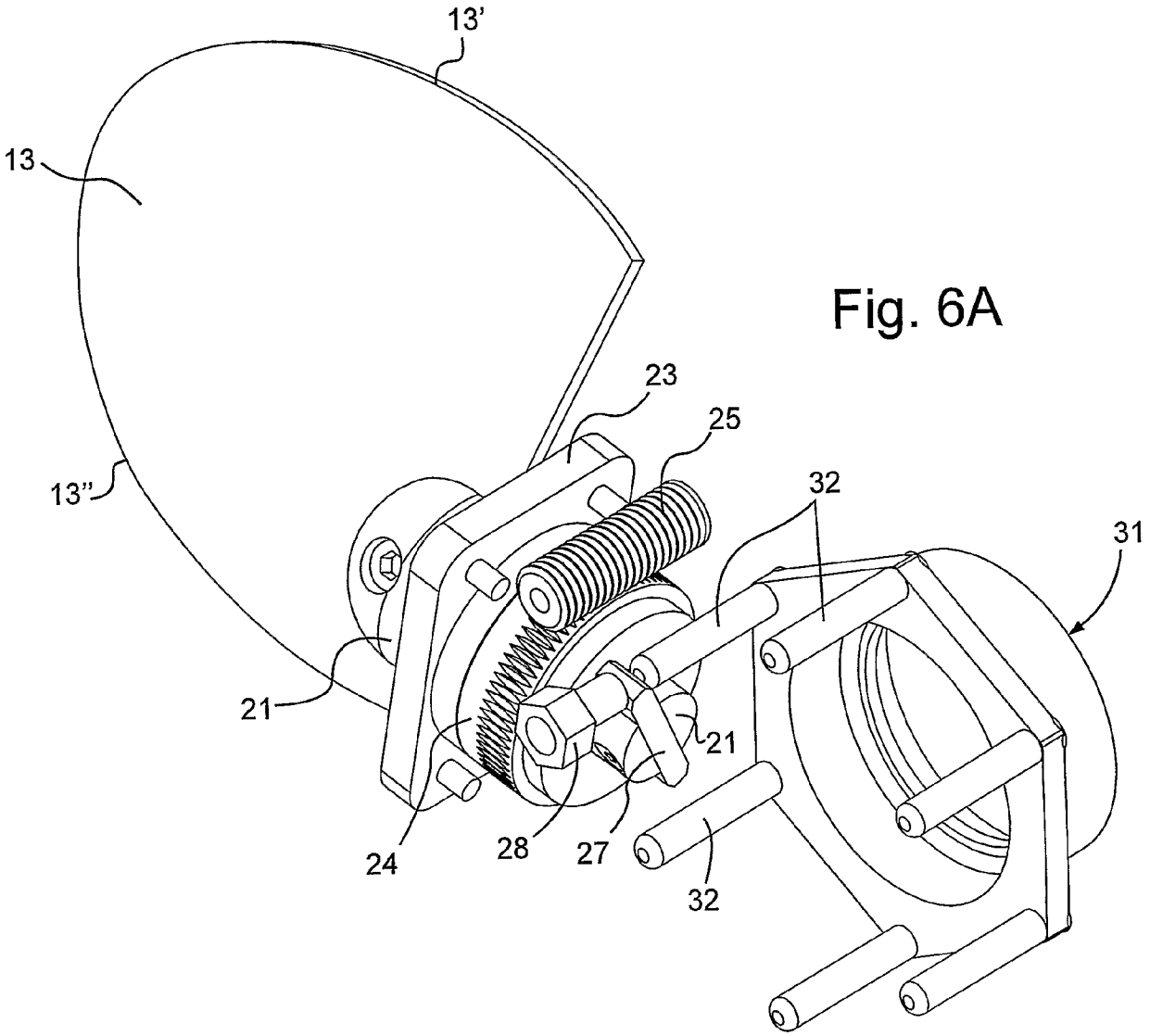
FIGS. 6A, 6B and 6C show, by means of a single blade, three different possible positions of the maximum possible opening of the blades.
Figure 6B:
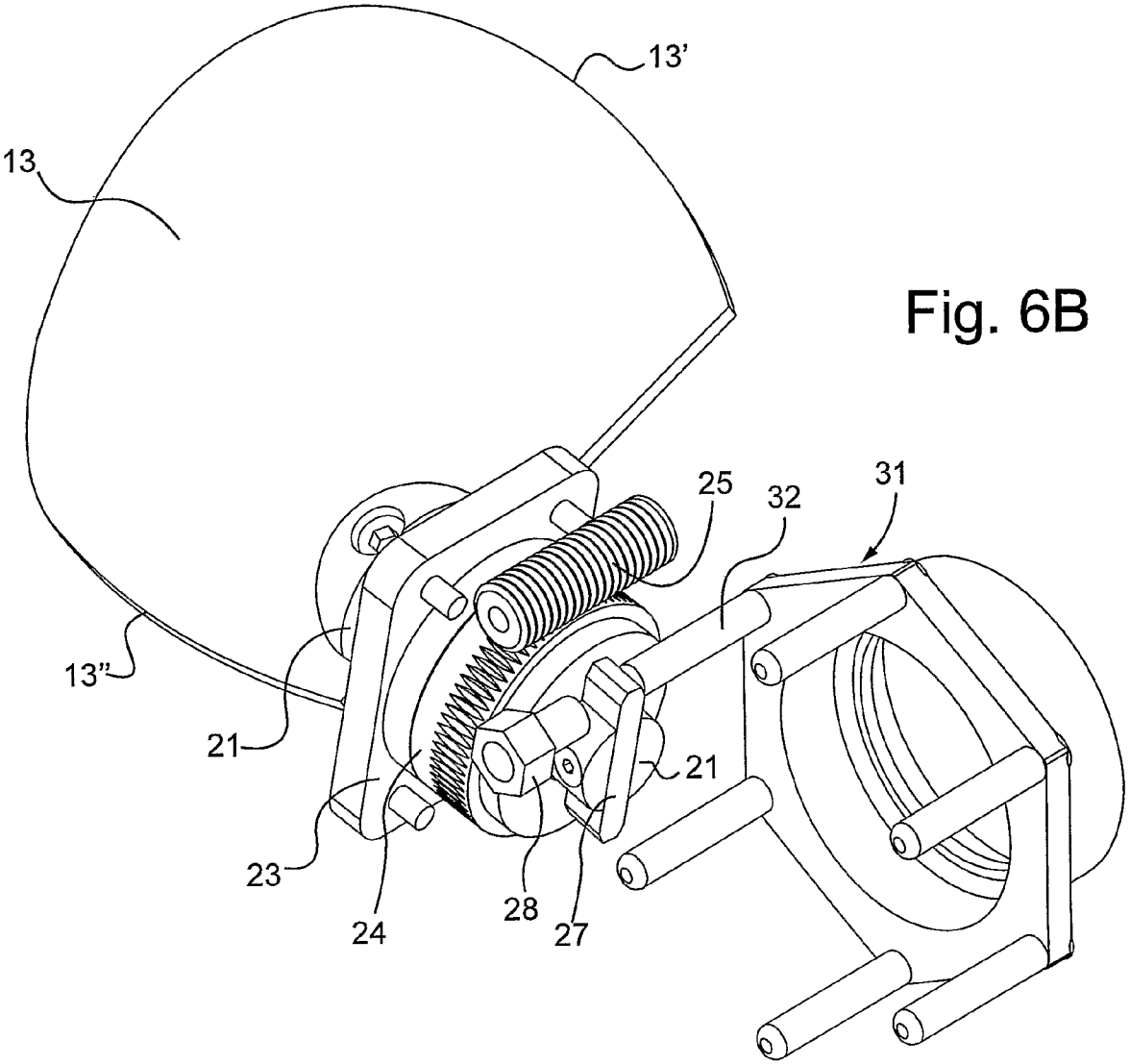
Figure 6C:
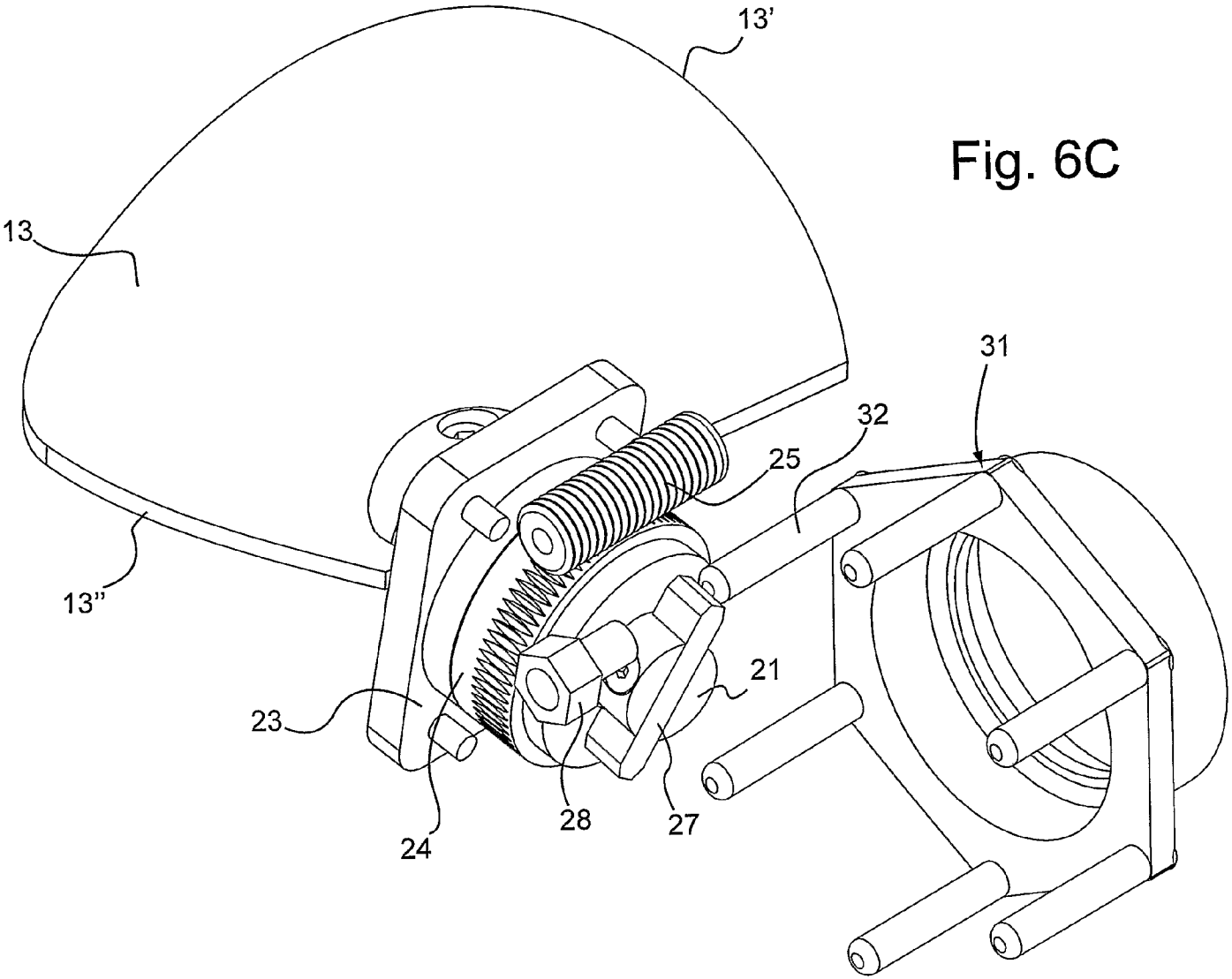

FIGS. 6A, 6B and 6C show, as an example on a single blade, three different positions of the movable end stop flange 31. They are respectively, a first position in which the blades 13 are fixed, in other words, the position of maximum possible opening coincides with the minimum opening position and corresponds to an angle of incidence in the water of about 30°; an example intermediate position; as well as a final position in which the blades 13 are left free to reach a position of maximum possible opening equal to an angle of incidence in the water of 90°.

According to the invention, any number of intermediate positions between the minimum and maximum opening of the blades 13 can be foreseen, just as different angles of the blades 13 in the minimum and maximum opening positions can also be foreseen.

The movable end stop flange 31 is able to translate towards and away from the initial position adjuster screw 28 by means of a cam mechanism, which according to a first embodiment, shown in FIG. 4, comprises an oscillating and translating slider 33 axially coupled to the flange 31, at one end, and at a bushing 34 on which it can rotate and slide, at the opposite end, as shown in FIG. 4.

The bushing 34 is indeed provided with a helical groove 35, in which a drive screw 36 is engaged that is locked on the slider 33 by a lock nut.

The connection between the flange 31, which rotates during operation, and the oscillating slider 33, which stays still, unless it is controlled to roto-translate for the adjustment, is obtained with two ball crowns 37 and with a relative ring 38 that identifies a seat for the balls 37 which is held in position by a clip ring.

Thanks to this, the system can also work with the rotor 10 moving, in other words, carrying out the adjustment while continuing to peddle.

The rotor 10 also comprises control means of the maximum possible opening 40, which can be set at the user's or instructor's discretion depending on the programmed exercise, for example light training, toning with variable intensity, rehabilitation with maximum intensity, or other.

The control means of the maximum possible opening 40 comprise, according to the preferred embodiment of the invention, a manoeuvring lever 41 applied on a frame 11 of the stationary water bicycle 100.

In practice this system gives the user the opportunity to vary the greater or smaller automatic opening of the blades in a continuous or differentiated manner as a function of the programmed workout.

Figure 5:
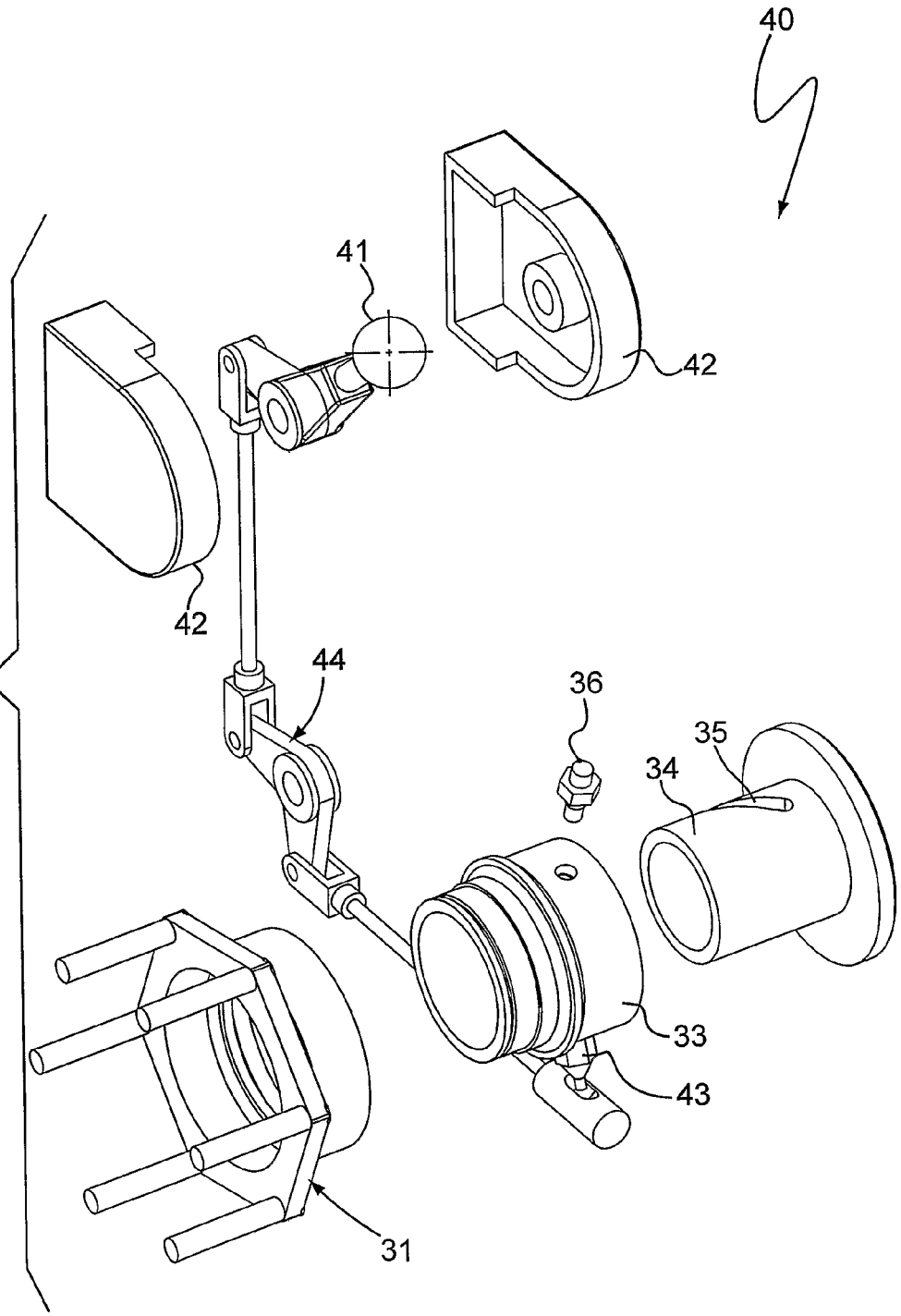
FIG. 5 is an exploded view of an example embodiment of the control means of the maximum possible opening of the blades, coupled with the means for adjusting the maximum possible opening of the blades of FIG. 4.

In the example shown in FIG. 5, the manoeuvring lever 41 is pivoted in a box 42, and can be rotated by about 90° continuously or in a preset number of positions.

Indeed, if the adjustment of the manoeuvring lever 41, which corresponds to a variation of the end stop of the blades 13, occurs continuously, it is possible to set any end stop value. Otherwise, if it occurs according to preset positions, even very close to one another, the end stop of the blades will move by discrete values.

The manoeuvring lever 41 is connected to a ball joint 43 of the oscillating slider 33 for example by means of rigid or flexible connection elements 44.

Figure 7:
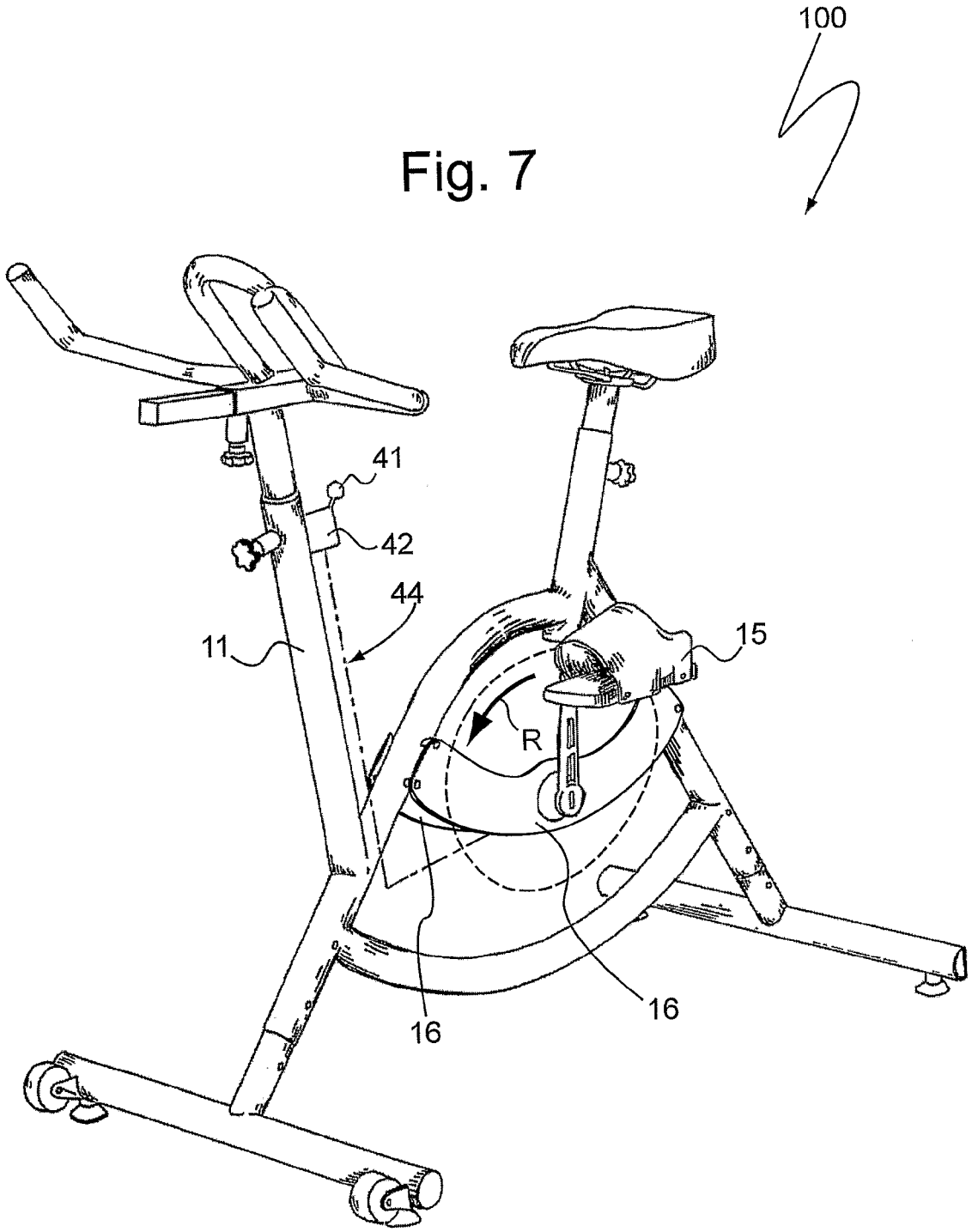
FIG. 7 is a perspective view of a stationary water bicycle carrying the rotor with variable hydrodynamic resistance according to the invention.

The connection elements 44 can be rigid tie rods and levers, suitably fixedly connected to the frame 11 of the bicycle 100, as well as other known systems, like for example, flexible wires contained by sheaths, as schematically shown in FIG. 7.

The control box 42 is mounted on the frame 11 of the bicycle 100 in a position such that it is as easy as possible to reach and manoeuvre.

For the different positions of the control lever 41 there are just as many corresponding angular positions of the oscillating slider 33 and axial sliding positions of the movable flange 31 and thus just as many levels of maximum opening of the blades.

Figure 12:
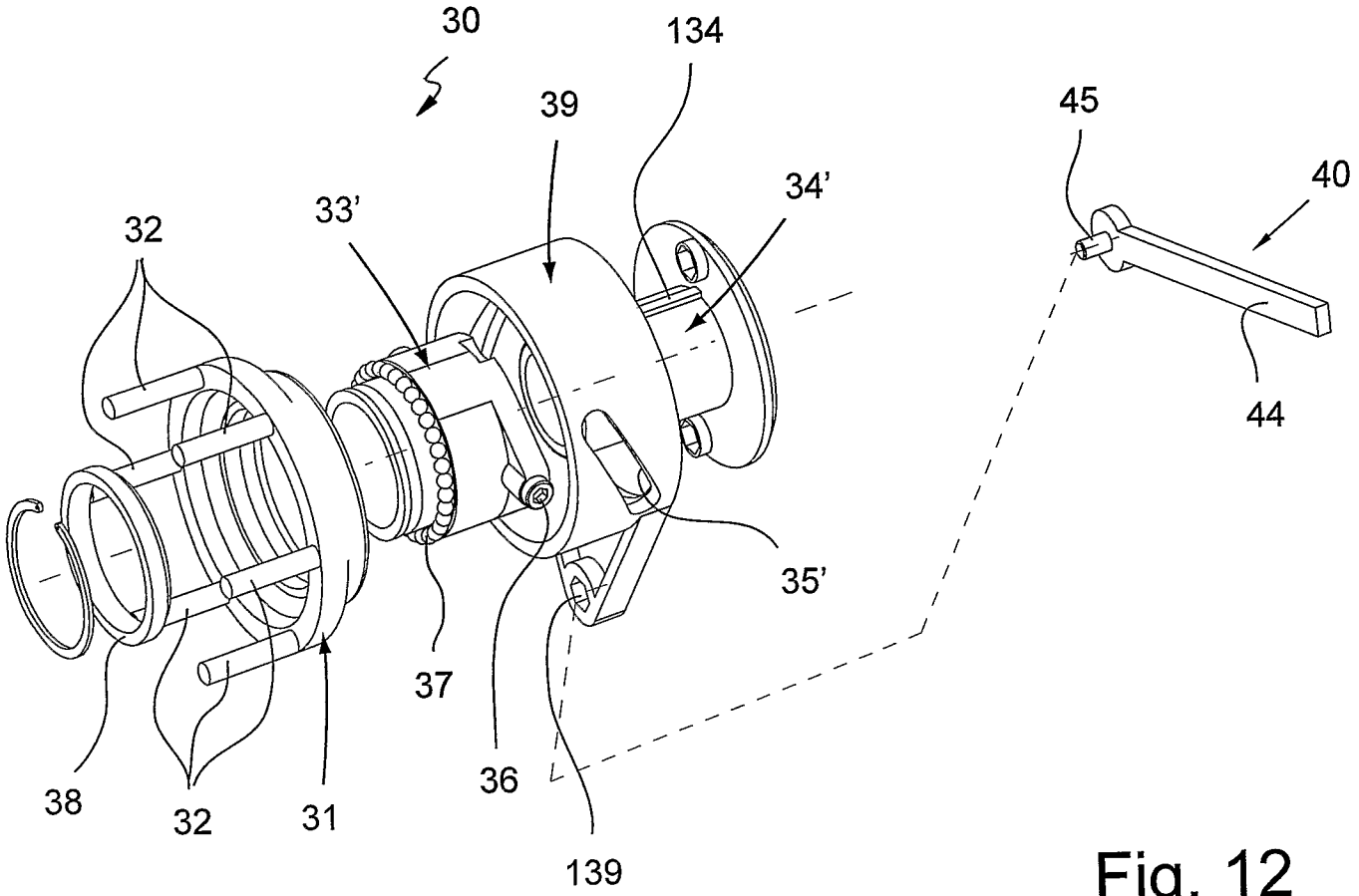
FIG. 12 shows an enlarged detail, in an exploded view, of a second embodiment of the means for adjusting the maximum possible opening of the blades, shown in the rotor of FIG. 11.

According to a further embodiment of the means for adjusting the maximum possible opening 30 of the blades, shown in the enlarged detail of FIG. 12 and in the exploded views of FIGS. 10 and 11, the movable end stop flange 31, which carries an abutment pin 32 for each blade 13, is able to translate towards and away from the initial position adjuster screw 28 by means of a cam mechanism that comprises a translating slider 33' coupled through a key 134 with a fixed bushing 34' with respect to one of the support plates 16, as well as an oscillating flange 39 directly set in rotation by the control means 40, which determines the axial movement of the translating slider 33'.

The oscillating flange 39 is indeed provided with a helical groove 35', in which a drive screw 36 is engaged locked on the translating slider 33'.

Even according to this embodiment, the connection between the flange 31 and the translating slider 33' is obtained with at least one ball crown 37 and a relative ring 38, held in position by a clip ring. Thanks to this, the system can also operate while the rotor 10 is moving, in other words, carrying out the adjustment while continuing to peddle.

The control means of the maximum possible opening 40, comprise the manoeuvring lever 41, which can be rotated continuously or in a preset number of positions, rigid or flexible connection elements 44, corresponding to those described above and ending with a cylindrical pin 45, arranged with the axis parallel to the axle of the rotor 10 connected to the oscillating flange 39 to set it in rotation.

In this last embodiment, the separation of the oscillating movements and of the axial translation in two distinct elements, in other words, the oscillating flange 39 and the translating slider 33', simplifies the mechanical coupling between parts. In particular, it is possible to replace the ball joint 43, which transmits the rotary motion to the oscillating slider 33 of FIGS. 4 and 10 and the axial motion follows, with the simple cylindrical pin 45, axially fixed and coupled with a hole 139 of the oscillating flange 39, the relative rotation between the cylindrical pin 45 and the hole 139 being free.

FIG. 7 shows, as an example, the stationary water bicycle 100, according to the invention, comprising the frame 11 on which the rotor 10 is applied, and to which the peddles 15 are connected.

The rotor 10, only schematically shown in FIG. 7 in a dashed and dotted line, is positioned on the frame 11 in a central position with the inlet edge 13' of the blades 13 frontally directed. The rotor 10 is possibly protected by an open casing, but it is preferably supported simply by two support plates 16, constrained to the frame 11, the function of which is also that of giving the structure stability.

The control means of the maximum possible opening 40 of the blades, connected to the adjustment means 30, are fixedly connected to the frame 11 so that the control lever 41 is in a position which is easy for the user to reach.

In a completely analogous manner, also the control means 60 of the centralized adjustment means of the load of the springs 50 are applied onto the frame 11 in a practical position for the action of a user.

The control means 40 and 60 can also undergo simultaneous activation since the relative adjustment means 30, 50 are arranged concentric and do not obstruct each other.

The rotor with variable hydrodynamic resistance for a stationary water bicycle and the related stationary water bicycle object of the present invention have the advantage of not foreseeing any manual adjustment of the opening of the blades which is automatic and can vary as a function of the peddling.

Advantageously, in the field of the same programmed activity both of water fitness and rehabilitation, or other, the blades never have the same opening since they are always moving (partial opening, gradual opening, total opening, etc. . . . ). The greater opening or closure thereof will depend upon the greater or lesser power imparted by the peddling of the end user.

A further advantage consists in the fact that the adjustment can be carried out without interrupting the peddling.

A further advantage of the centralized control of the load of all the spiral springs consists of the simplicity and rapidity of the adjustment, as well as of the reduction of possible calibration mistakes between one spring and the other.

The control means of the centralized adjustment means of the load of the springs can also advantageously be adjusted with the rotor in movement even simultaneously with the control means of the adjustment of the maximum adjustment opening of the blades.

Moreover, the rotor with variable hydrodynamic resistance for a stationary water bicycle, according to the invention, advantageously creates a water current that licks the surface of the legs amplifying the therapeutic benefits.

The rotor with variable hydrodynamic resistance for a stationary water bicycle and the relative bicycle thus conceived may undergo numerous modifications and variants, all covered by the invention; moreover, all the details can be replaced by technically equivalent elements. In practice the materials used, as well as the sizes, can be any according to the technical requirements.

The invention claimed is:

1. A rotor with variable hydrodynamic resistance for a stationary water bicycle comprising a central body provided on its outer perimeter with a plurality of blades, each blade of the plurality of blades comprising an inlet edge, an outlet edge and a convex helical surface, said rotor being provided on opposite outer faces with axles for pedals, wherein each blade, at said outlet edge, is connected to said rotor with elastic fixing means comprising a rotation pin of the blades that are placed in an extension of the outlet edge of the blades where said rotation pins are adapted to allow the automatic orientation of the blades as a function of the rotation speed imparted to the rotor through the pedals, wherein said central body houses means for adjusting the maximum possible opening of the blades comprising a mechanical end stop element movable for modifying the maximum possible opening of each blade, said means for adjusting the maximum possible opening being able to be actuated by control means which comprise a manoeuvring lever connected at one end to said means for adjusting the maximum possible opening wherein said rotation pins and said blades having said convex helical surface convey fluid and create a current that starts at a centre of said rotor that radiates towards the outer perimeter.

2. The rotor according to claim 1, wherein said means for adjusting the maximum possible opening comprise a movable end stop flange, that constitutes the mechanical end stop element, able to translate by means of a cam mechanism.

3. The rotor according to claim 2, wherein said movable end stop flange comprises a plurality of abutment pins, one for each blade, whose end is situated opposite a respective initial position adjuster screw.

4. The rotor according to claim 3, wherein said cam mechanism comprises an oscillating slider axially coupled to the movable end stop flange, at one end, and at a bushing on which it can rotate and slide, at the opposite end, wherein the bushing is provided with a helical groove, in which a drive screw is engaged, which is locked on the oscillating slider.

5. The rotor according to claim 4, wherein the coupling between the flange, which rotates during operation, and the oscillating slider, which stays still, is obtained with two ball crowns and a related ball seat ring which is held in position by a Seeger clip ring.

6. The rotor according to claim 3, wherein said cam mechanism comprises a translating slider axially coupled to the flange, at one end, and to an oscillating flange at the opposite end, wherein said oscillating flange is provided with a helical groove, in which a drive screw is engaged, which is locked on the slider, said translating slider being also able to slide axially on a fixed bushing.

7. The rotor according to claim 6, wherein the coupling between the movable end stop flange, which rotates during operation, and the translating slider is obtained with a ball crown and with a related ball seat ring which is held in position by a Seeger clip ring.

8. The rotor according to claim 1, wherein said rotation pin placed on the extension of the outlet edge of each blade is coupled with said central body of the rotor through elastic means which in part oppose its rotation and, in rest conditions, bring the blade back to a minimum opening position.

9. The rotor according to claim 8, wherein said elastic means are composed of a strip spring, wherein a first end engages with said rotation pin and a second end engages with an adjuster bushing, which contains said strip spring.

10. The rotor according to claim 9, wherein a worm screw is engaged with the outer surface of said adjuster bushing of the strip spring for the adjustment of the tension.

11. The rotor according to claim 9, wherein the rotor comprises centralized adjustment means of the load of the springs, comprising a fixed outer dome, a roto-translating thrust ring and an annular translating slider, said thrust ring being set in rotation by control means of the centralized adjustment means and guided in axial translation through the coupling between at least one drive screw of the thrust ring and at least one helical groove of the fixed outer dome, said annular slider being connected to said central body in an axially sliding manner and provided with a plurality of connection elements to each of said adjuster bushings.

12. The rotor according to claim 11, wherein each of said connection elements is made up of a threaded adjuster pin fixedly connected to a flat annular surface of said annular slider and engaged with the outer surface of said adjuster bushing of the strip spring for the adjustment of the tension.

13. The rotor according to claim 11, wherein each of said connection elements is made up of an adjuster lever hinged on an outer shell of said annular slider and outside said adjuster bushing of the strip spring for the adjustment of the tension.

14. The rotor according to claim 11, wherein the coupling between said thrust ring and said annular slider is obtained with a ball crown and with a relative ball seat ring which is held in position by a Seeger clip ring.

15. The rotor according to claim 8, wherein the rotor comprises, for each blade, an initial position adjuster screw for adjusting the minimum opening position, said screw being couplable in abutment with a cross beam placed at the end of said rotation pin.

16. A stationary water bicycle comprising a frame and pedals connected to a rotor with variable hydrodynamic resistance where said rotor comprises a central body provided on its perimeter with a plurality of blades, each blade of said plurality of blades comprising an inlet edge, an outlet edge and a convex helical surface, said rotor being provided on opposite outer faces with axles for said pedals, wherein each blade, at said outlet edge, is connected to said rotor with elastic fixing means comprising a rotation pin of the blades that are placed in an extension of the outlet edge of the blades where said rotation pins are connected to springs and are adapted to allow the automatic orientation of the blades as a function of the rotation speed imparted to the rotor through the pedals, wherein said central body houses means for adjusting the maximum possible opening of the blades comprising a mechanical end stop element movable for modifying the maximum possible opening of each blade, said means for adjusting the maximum possible opening being able to be actuated by control means which comprise a manoeuvring lever connected at one end to said means for adjusting the maximum possible opening and control means for centralized adjustment of a load on said springs connected to said rotation pins wherein said rotation pins and said blades having said convex helical surface convey fluid and create a current that starts at a centre of said rotor that radiates towards the outer perimeter wherein said rotor is connected to pedals and positioned on said frame in a central position with the inlet edge of the blades frontally directed, said control means of the maximum possible opening or said control means of said centralized adjustment of the load of said springs connected to said rotation pins of the blades, being fixedly connected to said frame.

* * * * *